US006033210A

United States Patent [19]

Freeman

[11] Patent Number: 6,033,210

[45] Date of Patent: Mar. 7, 2000

[54] PARAFFIN/PETROLATUM CANDLE AND METHOD OF FORMING THE SAME

[76] Inventor: Scott Freeman, 3632 Rebel Cir., Huntington Beach, Calif. 92649

[21] Appl. No.: 09/337,292

[22] Filed: Jun. 21, 1999

[51] Int. Cl.[7] ..... F23D 3/16

[52] U.S. Cl. ..... 431/291; 362/161

[58] Field of Search ..... 431/291; 362/161

[56] References Cited

U.S. PATENT DOCUMENTS

| | | | |
|---|---|---|---|
| 4,427,366 | 1/1984 | Moore | 431/291 |
| 5,578,089 | 11/1996 | Elsamaloty | 431/291 |

OTHER PUBLICATIONS

"What is Wax?—Petroleum Wax Manufacturing==Simple Overview"—2 Web pages, 1997.

"Candle Making—Waxes"—3 Web pages No Date.

"Making Candles", By Mary Talbot, 3 pages No Date.

"Candle Creations", By James W. Gick, Jr., Index and Foreword and 3 pages 1997.

"Homespun Floral Candles", Country Living Gardener, Nov./Dec. 1996, pp. 92 and 93.

*Primary Examiner*—Carroll Dority

*Attorney, Agent, or Firm*—Stetina Brunda Garred & Brucker

[57] ABSTRACT

A decorative candle comprising a container that defines an interior chamber. Disposed within the interior chamber is a candle core sized relative to the container such that a cavity is formed between the candle core and the container. At least one component is disposed within the cavity in abutting contact with the candle core and the container. The component is encapsulated by a mixture that has a melting point lower than the candle core and the component such that neither the candle core nor the component melt when the molten mixture is poured within the cavity. In the preferred embodiment of the present invention, the candle core is a paraffin wax candle core and the mixture is a paraffin/petrolatum mixture. Furthermore, the component may be a gelatinous component formed from a mineral oil gel.

20 Claims, 1 Drawing Sheet

PARAFFIN/PETROLATUM CANDLE AND METHOD OF FORMING THE SAME

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to decorative candles and more particularly to a decorative candle having uniquely shaped, integral gel components suspended within the candle by a petrolatum and paraffin mixture.

Candles have become popular for decorative purposes and as such are being formed in different styles, shapes, and colors. Typically, there are three different types of candles: tapered, molded and container. The candles may be manufactured from a wax such as paraffin, vegetable, or beeswax.

A container candle is formed by pouring molten wax into a container having a wick disposed therein. The wick is extensible through the wax such that as the wick is burned, the wax around the wick will melt thereby providing fuel for the wick to burn. A molded candle is formed by pouring melted wax into a mold containing a wick. The wax is allowed to cool such that it solidifies and is then removable from the mold thereby forming the candle. Tapered candles are formed by dipping a wick into melted wax. Each time the candle is dipped into the melted wax, the wax adheres to itself thereby forming the tapered candle.

Fragrances and/or pigments can be added to the wax to give the candle a unique appearance. Typically, the fragrance and/or pigment is mixed with the wax when in a molten state. The wax containing the fragrance and/or pigment is then formed into the preferred type of candle. The pigment will give the candle a desired coloring, while the fragrance gives the candle a preferred scent. The scent produced by the fragrance may become more pronounced as the candle is being burned.

In addition to making candles out of wax, mineral oil has been used to make candles (i.e., gel candles). The mineral oil is gelatinous and a solid at ambient temperature. Typically, a gel candle is formed by pouring molten mineral oil into a container having a wick. The mineral oil is allowed to cool to its gelatinous state thereby forming a candle within the container. Gel candles burn longer than candles made from paraffin wax because of the high oil content of the gel. Furthermore, gel candles may additionally be scented and/or colored to add more variety to the candles. Additionally, gel components may be fabricated from the mineral oil gel. The gel components are individual pieces of mineral oil gel fabricated into prescribed shapes. The individual gel components may then be placed on the top of a wax candle to provide a more decorative appearance. However, the gel components will not easily adhered to the sides of the wax candle.

The present invention provides a candle whereby the gel components are easily and securely adhered to the sides of a wax candle in order to provide a decorative appearance. The present invention therefore provides a decorative candle whereby the gel components create artistic and decorative wax candles.

BRIEF SUMMARY OF THE INVENTION

In accordance with the present invention there is provided a method of manufacturing a decorative candle. The method comprises the step of providing a container which defines an interior chamber. Next, a candle core is inserted into the interior chamber. The candle core is sized relative to the container such that a space or cavity is formed between the container and the candle core when the candle core is inserted within the interior chamber. Then, at least one component is inserted into the cavity. The component is in abutting contact with the container and the candle such that the component is wedged in place therebetween. A molten mixture is then poured into the cavity such that the component is surrounded thereby. The mixture is allowed to cool thereby securing the component. The melting point of the mixture is less than the melting point of the component and the candle core such that the candle core and the component do not melt when the mixture is poured within the cavity.

The component may be a gelatinous component formed by providing a quantity of mineral oil gel and then melting the gel until it liquefies. Next, the liquefied mineral oil gel is formed into a planar sheet and allowed to cool until the sheet solidifies. The sheet is then cut with a die to form the individual gel components. Alternatively, the liquefied mineral oil gel may be extruded and cooled through a die to form an extruded member. Next, the extruded member is cut to form the individual gelatinous components. In either instance, fragrance and/or pigment may be added to the molten mineral oil gel for the desired effect.

In the preferred embodiment of the present invention, the container may be a translucent glass container. Furthermore, the candle core may be a paraffin wax candle core and the mixture may be a mixture of petrolatum and paraffin. Fragrance and/or pigment may be added to the candle core and/or the mixture of petrolatum and paraffin as desired.

BRIEF DESCRIPTION OF THE DRAWINGS

These as well as other features of the present invention, will become more apparent upon reference to the drawings wherein.

DETAILED DESCRIPTION OF THE INVENTION

Figure 1:
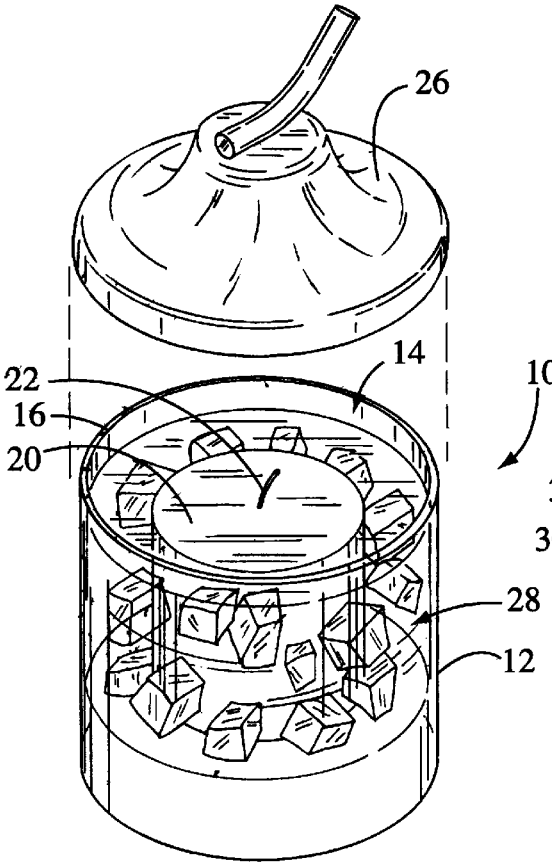
FIG. 1 is a perspective view of a paraffin/petrolatum candle constructed in accordance with the preferred embodiment of the present invention.

Referring now to the drawings wherein the showings are for purposes of illustrating a preferred embodiment of the present invention only, and not for purposes of limiting the same, FIG. 1 perspectively illustrates a candle 10 manufactured in accordance with the present invention. The candle 10 includes a generally cylindrical container 12 having a rim 16 defining an open top end 16 that allows access into an interior chamber 18. Preferably, the container 12 is made from a translucent material such as glass, however it will be recognized that other types of materials can be used. Additionally, the container 12 can be formed into different shapes such as rectangular, spherical or triangular. The candle 10 may additionally include a top cover 26 which is placeable over the open end 14 of container 12. The top cover 26 is sized to be supported by the rim 16 such that the cover 26 can seal the open end 14 of the container 12 and extinguish any flame of candle 10.

Figure 2:
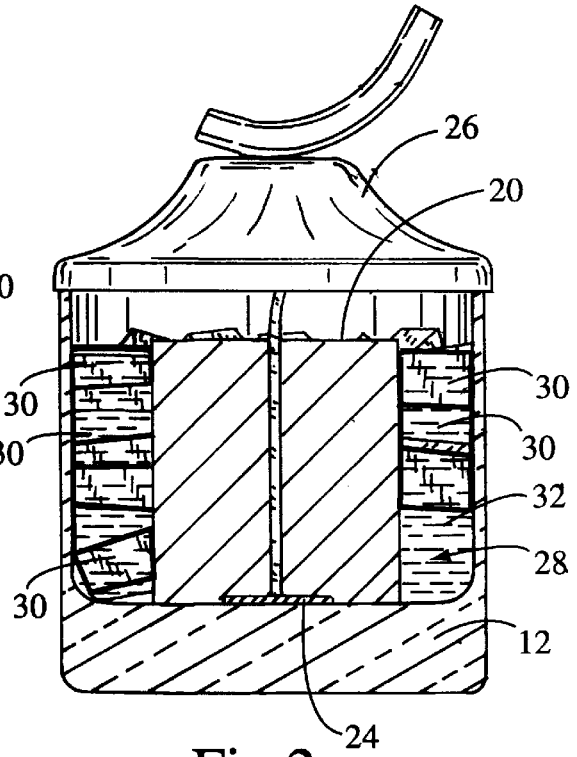
FIG. 2 is a cross-sectional view of the candle shown in FIG. 1.

Disposed within the interior chamber 18 of container 12 is a candle core 20. The candle core 20 can be a conventional paraffin wax votive candle as is currently known in the art having a melting temperature between about 125° F. to about 145° F. The candle core 20 can be translucent and/or colored with a FD&C ornamental pigment or dye. Additionally, the candle core 20 may be manufactured with a fragrance such as an oil for aromatherapy during burning thereof. Disposed within the candle core 20 is a wick 22 made from woven cotton or linen thread. The wick 22 may be inserted into the candle core 20 when poured, or the candle core 20 may be drilled through the center and the wick 22 inserted therethrough. In order to secure the wick 22 to the candle core 20, the wick 22 may be attached to a wick holder 24, as seen in FIG. 2. The wick holder 24 is placed into the bottom surface of the candle core 20 such that the wick 22 is not removable therefrom. The candle core 20 is sized to be smaller than an inner diameter of the interior chamber 18. In this respect, a void or cavity 28 is created between the container 12 and the candle core 20 when inserted therein.

Figure 3:
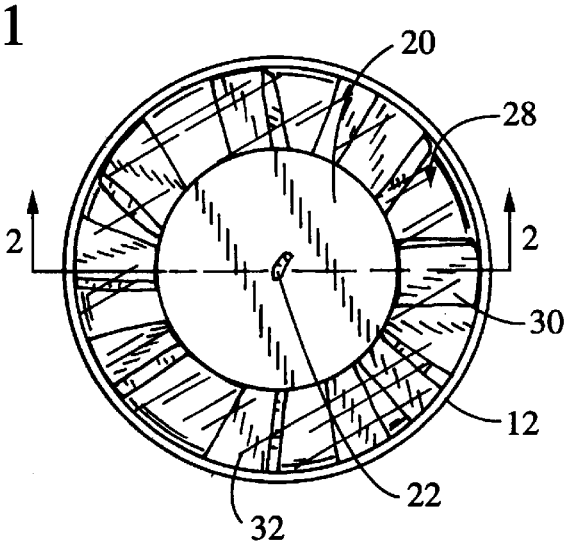
FIG. 3 is a top plan view of the candle shown in FIG. 1.

In accordance with the preferred embodiment of the present invention, the candle 10 further includes a plurality of gelatinous components 30 disposed within the cavity 28, as seen in FIGS. 1 and 2. Each of the gelatinous components 30 is manufactured from a mineral oil gel. The mineral oil gel is solid, yet flexible and capable of retaining its shape unsupported at ambient temperature. Pigments and/or fragrances may be mixed with the gel in order to provide a desired color and/or scent. Examples of such mineral oil gels are "Candle Gel" and "Versa Gel" both of which are manufactured by Penrico of Woodlands, Tex. Each gelatinous component 30 can be configured into decorative designs and shapes that adorn the candle 10. As seen in FIGS. 2 and 3, each gelatinous component 30 is in abutting contact with the candle core 20 and the container 12. In this respect, each gelatinous component 30 is frictionally secured (i.e., wedged) in position by the container 12 and the candle core 20.

The candle 10 further includes a mixture of petrolatum and paraffin 32 disposed between the candle core 20 and the container 12. As seen in FIG. 2, the petrolatum/paraffin mixture 32 encapsulates each gel component 30. The petrolatum/paraffin mixture 32 is a solid at ambient temperature that can be melted and poured around the gel components 30. The petrolatum/paraffin mixture 30 has a melting point that is lower than the gel components 30 such that the molten petrolatum/paraffin mixture 30 can be poured into the container 12 without melting the gel components 30. Once cooled to ambient temperature, the petrolatum/paraffin mixture 32 supports each gel component 30 in a desired position. The petrolatum/paraffin mixture 32 can be translucent or colored with pigments. Additionally, fragrance such as a scented oil can be added to the petrolatum/paraffin mixture 32 in order to provide a scent.

In addition to gelatinous components 30, scented stones may also be placed within the cavity 28. The stones are fabricated with scented oils, such as potpourri oil, that emits a fragrance. The stones are placed between the container 12 and the candle core 20 and secured in place with the petrolatum/paraffin mixture 32. As the candle is burned, the fragrance from the stones is emitted. As will be recognized by those of ordinary skill in the art, other types of decorative elements such as beads may be placed within cavity 28 in order to provide varying artistic effects. Furthermore, the petrolatum/paraffin mixture 32 may be created with air bubbles contained therein to simulate a "champagne" effect for candle 10.

In accordance with the present invention there is also provided a method of manufacturing the candle 10. The method comprises inserting the candle core 20 having wick 22 into the interior chamber 18 of container 12. Next, the gel components 30 are inserted into the interior cavity 28. The gel components 30 are manufactured by melting a prescribed quantity of mineral oil gel to it's melting temperature. Next, the molten mineral oil gel may be poured to form a generally planar sheet. The mineral oil gel is then allowed to cool until the sheet solidifies. Once solid, the sheet is cut with a die to form the gel components 30. Alternatively, the molten mineral oil gel may be extruded and cooled through a die. The extruded mineral oil gel is then cut into the desired thickness. Once the gel components 30 are formed, they are inserted between the candle core 20 and the container 12. The gel components 30 are sized slightly larger than the width of cavity 28 such that each gel component 30 may be wedged into a desired position between the container 12 and the candle core 20.

The petrolatum/paraffin mixture 32 is formed by melting a prescribed quantity of petrolatum and a prescribed quantity of paraffin wax. Once both the petrolatum and paraffin are melted, then they can be mixed together. The petrolatum/paraffin mixture 32 is then heated until it liquefies and can be poured into cavity 28. The temperature of the molten petrolatum/paraffin mixture 32 is lower than the melting point of the gel components 30 and the candle core 20. Therefore, the molten petrolatum/paraffin mixture 32 does not melt the gel components 30 nor the candle core 20. Additionally, the low melting point of the petrolatum/paraffin mixture 32 reduces shrinkage and set-up time for the candle 10. Furthermore, the container 12 and the candle core 20 function as a heat sink to further draw heat away from the petrolatum/paraffin mixture 32 such that cooling times for the mixture are greatly reduced.

Once the petrolatum/paraffin mixture 32 has cooled and solidified, the gel components 30 are firmly retained in place. In this respect, the gel components 30 are in abutting contact with the container 12 such that a side of each gel component 30 is viewable through the container 12.

Additional modifications and improvements of the present invention may also be apparent to those of ordinary skill in the art. Thus, the particular combination of parts described and illustrated herein is intended to represent only a certain embodiment of the present invention, and is not intended to serve as limitations of alternative devices within the spirit and scope of the invention.

What is claimed is:

1. A method of manufacturing a decorative candle comprising the steps of:

a) providing a container which defines an interior chamber;

b) inserting a core candle having a first melting point into the interior chamber, the core candle being sized relative to the container such that a cavity is defined between the core candle and the container when the core candle is inserted into the interior chamber;

c) inserting at least one component having a second melting point into the cavity;

d) pouring a molten mixture into the cavity, the molten mixture having a third melting point lower than both the first and second melting points; and e) cooling the mixture to secure the component between the core candle and the container.

2. The method of claim 1 wherein step (b) comprises inserting a paraffin wax core candle into the interior chamber.

3. The method of claim 1 wherein step (c) comprises inserting a gelatinous component into the cavity.

4. The method of claim 3 wherein step (c) comprises:

1) providing a quantity of mineral oil gel;

2) melting the mineral oil gel;

3) forming the molten mineral oil gel into a generally planar sheet;

4) cooling the mineral oil gel until the sheet solidifies; and 5) cutting the sheet with a die to form the gelatinous component.

5. The method of claim 4 wherein step (c) (2) further comprises adding a fragrance and a pigment to the molten mineral oil gel.

6. The method of claim 3 wherein step (c) comprises:

1) providing a quantity of mineral oil gel;

2) melting the mineral oil gel;

3) extruding and cooling the mineral oil gel through a die to form an extruded member; and 4) cutting the member to form at least one gelatinous component.

7. The method of claim 6 wherein step (c) (2) further comprises adding a fragrance and a pigment to the molten mineral oil gel.

8. The method of claim 1 wherein step (d) comprises pouring a molten mixture of paraffin and petrolatum into the container.

9. The method of claim 8 wherein step (d) comprises:

1) melting a prescribed quantity of paraffin wax;

2) melting a prescribed quantity of petrolatum; and 3) mixing the molten paraffin wax and the molten petrolatum to form the molten mixture of paraffin and petrolatum.

10. The method of claim 1 wherein step (c) comprises inserting multiple components into the cavity.

11. The method of claim 1 wherein:

step (b) comprises inserting a paraffin wax core candle into the interior chamber;

step (c) comprises inserting a gelatinous component into the cavity; and step (d) comprises pouring a molten mixture of paraffin and petrolatum into the cavity.

12. A decorative candle comprising:

a container which defines an interior chamber;

a candle core having a first melting point disposed within the interior chamber, the candle core being sized relative to the container such that a cavity is defined between the candle core and the container when the candle core is inserted into the interior chamber;

at least one component having a second melting point disposed within the cavity; and a mixture having a third melting point lower than the first and second melting points, the mixture being disposed within the cavity and configured to retain the component.

13. The decorative candle of claim 12 wherein the component is a gelatinous component.

14. The decorative candle of claim 13 wherein the gelatinous component is formed from a mineral oil gel.

15. The decorative candle of claim 14 wherein the mineral oil gel includes a fragrance and a pigment.

16. The decorative candle of claim 12 wherein the candle core is a paraffin wax candle core.

17. The decorative candle of claim 16 wherein the candle core includes a pigment and a fragrance.

18. The decorative candle of claim 12 wherein the mixture is a paraffin and petrolatum mixture.

19. The decorative candle of claim 12 wherein multiple components are disposed between the container and the candle core.

20. The decorative candle of claim 12 wherein:

the candle core is a paraffin wax candle core;

the component is a gelatinous component; and the mixture is a paraffin and petrolatum mixture.

* * * * *